US012473065B2

(12) United States Patent
Uchino et al.

(10) Patent No.: US 12,473,065 B2
(45) Date of Patent: Nov. 18, 2025

(54) PERSONAL WATERCRAFT

(71) Applicant: Kawasaki Motors, Ltd., Hyogo (JP)

(72) Inventors: Yoshihito Uchino, Akashi (JP); Satoru Watabe, Akashi (JP)

(73) Assignee: KAWASAKI MOTORS, LTD., Akashi (JP)

( * ) Notice: Subject to any disclaimer, the term of this patent is extended or adjusted under 35 U.S.C. 154(b) by 678 days.

(21) Appl. No.: 17/875,445

(22) Filed: Jul. 28, 2022

(65) Prior Publication Data

US 2024/0034449 A1 Feb. 1, 2024

(51) Int. Cl.
*B63H 25/04* (2006.01)
*B63H 11/04* (2006.01)

(52) U.S. Cl.
CPC ..... *B63H 11/04* (2013.01); *B63H 25/04* (2013.01)

(58) Field of Classification Search
CPC ..... G05D 1/0206; B63B 79/15; B63B 79/40; B63B 2213/02; B63B 9/40; B63B 49/00; B63B 34/10; B63B 79/00; B60L 15/20; B60L 2200/32; H04W 4/80; H04W 4/021; B63J 99/00; G02B 6/0073; B63H 25/04; B63H 2025/045; Y02T 10/72
See application file for complete search history.

(56) References Cited

U.S. PATENT DOCUMENTS 7,744,433 B2 * 6/2010 Ozaki ..... B63B 34/10 440/1
8,096,844 B2 * 1/2012 Maeda ..... F02P 5/1508 440/87
2013/0102206 A1 4/2013 Fujino et al.
2024/0159542 A1 * 5/2024 Amma ..... G01C 21/203
2024/0174328 A1 * 5/2024 Amma ..... B63B 49/00

OTHER PUBLICATIONS

Micheau et al., Engine speed limiter for watercrafts, 2006, IEEE, p. 579-583 (Year: 2006).*
Moulton et al., An Autonomous Surface Vehicle for Long Term Operations, 2018, IEEE, p. 1-10 (Year: 2018).*
Cheng et al., Zero emission electric vessel development, 2015, IEEE, p. 1-5 (Year: 2015).*
Kragelund et al., Adaptive speed control for autonomous surface vessels, 2013, IEEE, p. 1-10 (Year: 2013).*

* cited by examiner

*Primary Examiner* — Mcdieunel Marc
(74) *Attorney, Agent, or Firm* — XSENSUS LLP

(57) ABSTRACT

A jet-propelled boat includes a power unit that applies a propulsive force to a ship body by injecting water taken in from a water inlet while pressurizing the water, a position detection unit that detects a position of the ship body, a determination unit that determines whether or not an operation mode is a fixed position mode, and a power control unit that controls the power unit based on detection information by the position detection unit so that a position of the ship body falls within a target range including a specific anchor position in a case where the determination unit determines that the operation mode is the fixed position mode.

14 Claims, 12 Drawing Sheets

PERSONAL WATERCRAFT

BACKGROUND

Technical Field

The present disclosure relates to a jet-propelled boat that planes on water.

Background Art

As a type of jet-propelled boat, a jet-propelled boat described in US2013/0102206A1 is known. In order to improve the convenience of the jet-propelled boat, it is desirable to facilitate ship handling by performing control according to the situation.

SUMMARY

The present disclosure has been made in view of the above circumstance, and an object is to provide a jet-propelled boat excellent in convenience.

In order to solve the above problem, a jet-propelled boat according to an aspect of the present disclosure includes: a ship body provided with a water inlet; a power unit that applies a propulsive force to the ship body by injecting water taken in from the water inlet while pressurizing the water; a position detection unit that detects a position of the ship body; a determination unit that determines whether or not an operation mode is a fixed position mode; and a power control unit that controls the power unit based on detection information by the position detection unit so that a position of the ship body falls within a target range including a specific anchor position in a case where the determination unit determines that the operation mode is the fixed position mode.

DETAILED DESCRIPTION

Embodiments of a jet-propelled boat according to the present disclosure will be described below with reference to the drawings. Some drawings are given indication of front, rear, left, and right directions, and these directions coincide with the direction viewed from the driver on the jet-propelled boat.

(1) First Embodiment

[Configuration of Jet-Propelled Boat]

Figure 1:
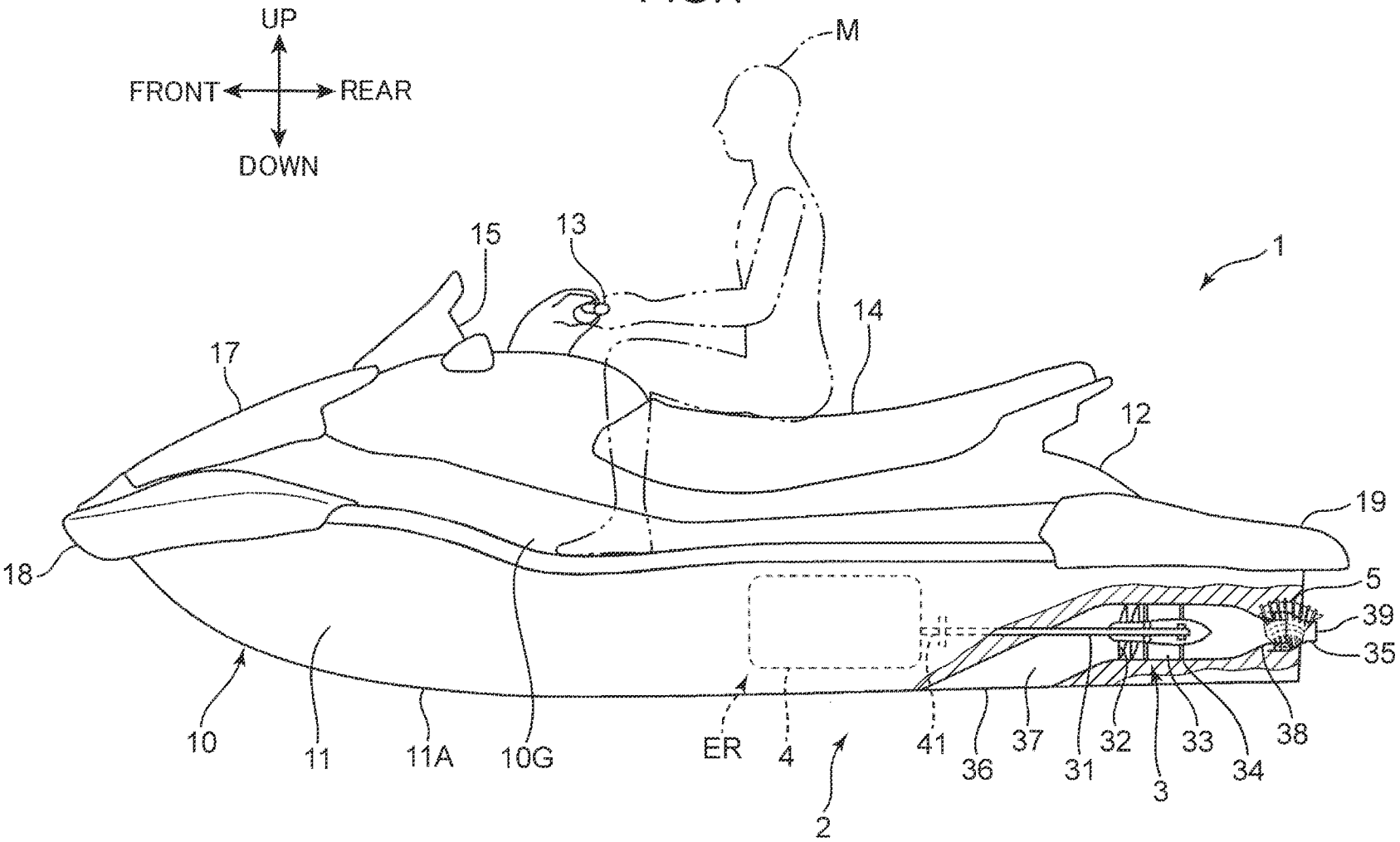
FIG. 1 is a partially broken side view of a jet-propelled boat according to a first embodiment of the present disclosure.
Figure 2:
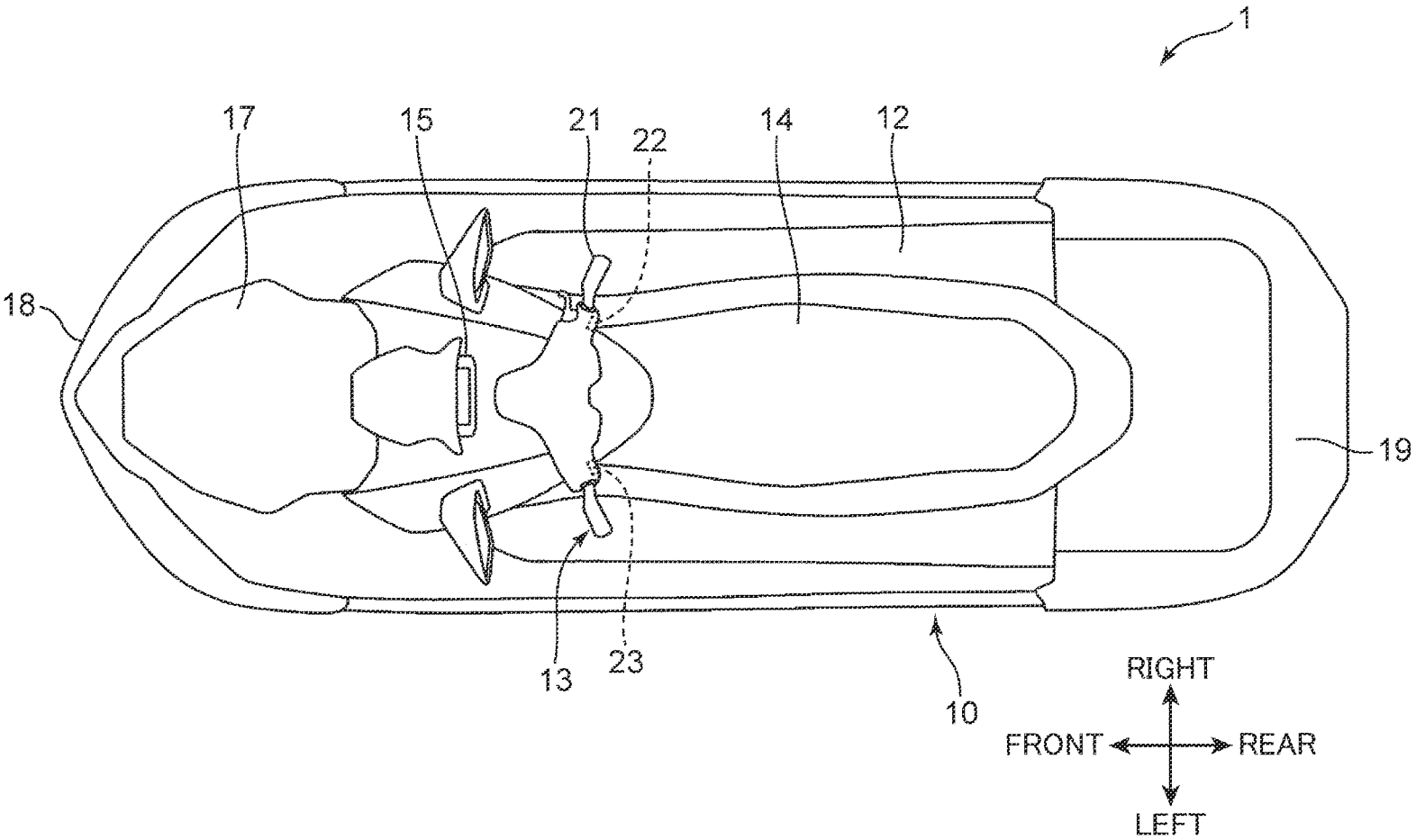
FIG. 2 is a plan view of the jet-propelled boat.

FIG. 1 is a partially broken side view of a jet-propelled boat 1 according to the first embodiment of the present disclosure, and FIG. 2 is a plan view of the jet-propelled boat 1. The jet-propelled boat 1 is a straddle-type boat called a personal watercraft (PWC) that jets a water flow rearward and navigates in reaction to the water flow. The jet-propelled boat 1 includes a ship body 10, a power unit 2 that generates a propulsive force for moving the ship body 10 on water, and a controller 7 (FIG. 3) that controls the power unit 2.

The ship body 10 includes a hull 11 and a deck 12 that overlies the hull 11. The hull 11 and the deck 12 are connected to each other over the entire circumference by a gunnel line 10G. A water inlet 36 is formed in a rear region of a bottom surface 11A of the hull 11, and an impeller passage 37 extending rearward with the water inlet 36 as an inlet is formed so as to penetrate the rear part of the hull 11 in the front-rear direction. The power unit 2 applies a propulsive force to the ship body 10 by injecting rearward, through the impeller passage 37, water taken in from the water inlet 36.

The deck 12 includes a front hatch 17, a front bumper 18, and a rear cover 19. The front hatch 17 covers an upper surface opening of a luggage storage space formed in a front part of the deck 12. The front bumper 18 covers the foremost part of the ship body 10. The rear cover 19 is disposed so as to cover the hull 11 behind a seat 14 described later, and is used, for example, when an occupant returns from the water to the ship body 10. The rear cover 19 can also be used as luggage placement for placing luggage, for example.

A handlebar 13, the seat 14, and a display 15 are disposed on the deck 12. The seat 14 is a seat on which a driver M who drives the jet-propelled boat 1 sits. The handlebar 13 is a steering handlebar operated by the driver M for steering the jet-propelled boat 1. The display 15 is an indicator that displays various types of information related to navigation of the jet-propelled boat 1, such as planing speed, a remaining amount of fuel, and an operation mode.

The handlebar 13 is disposed at a front upper part of the deck 12. As illustrated in FIG. 2, the handlebar 13 is provided with an accelerator 21, a start switch 22, and a stop switch 23. The accelerator 21 is a grip that is twisted to adjust the planing speed of the jet-propelled boat 1. The start switch 22 is a switch that starts an engine 4. The stop switch 23 is a switch that stops the engine 4.

The seat 14 extends in the front-rear direction behind the handlebar 13 and is disposed so as to partially cover the upper surface of the deck 12. The seat 14 is only required to be a seat on which at least the driver M can sit. That is, the seat 14 may be a multiple-seat in which not only the driver M but also fellow passengers can sit, or may be a single-seat in which only the driver M can sit.

Figure 3:
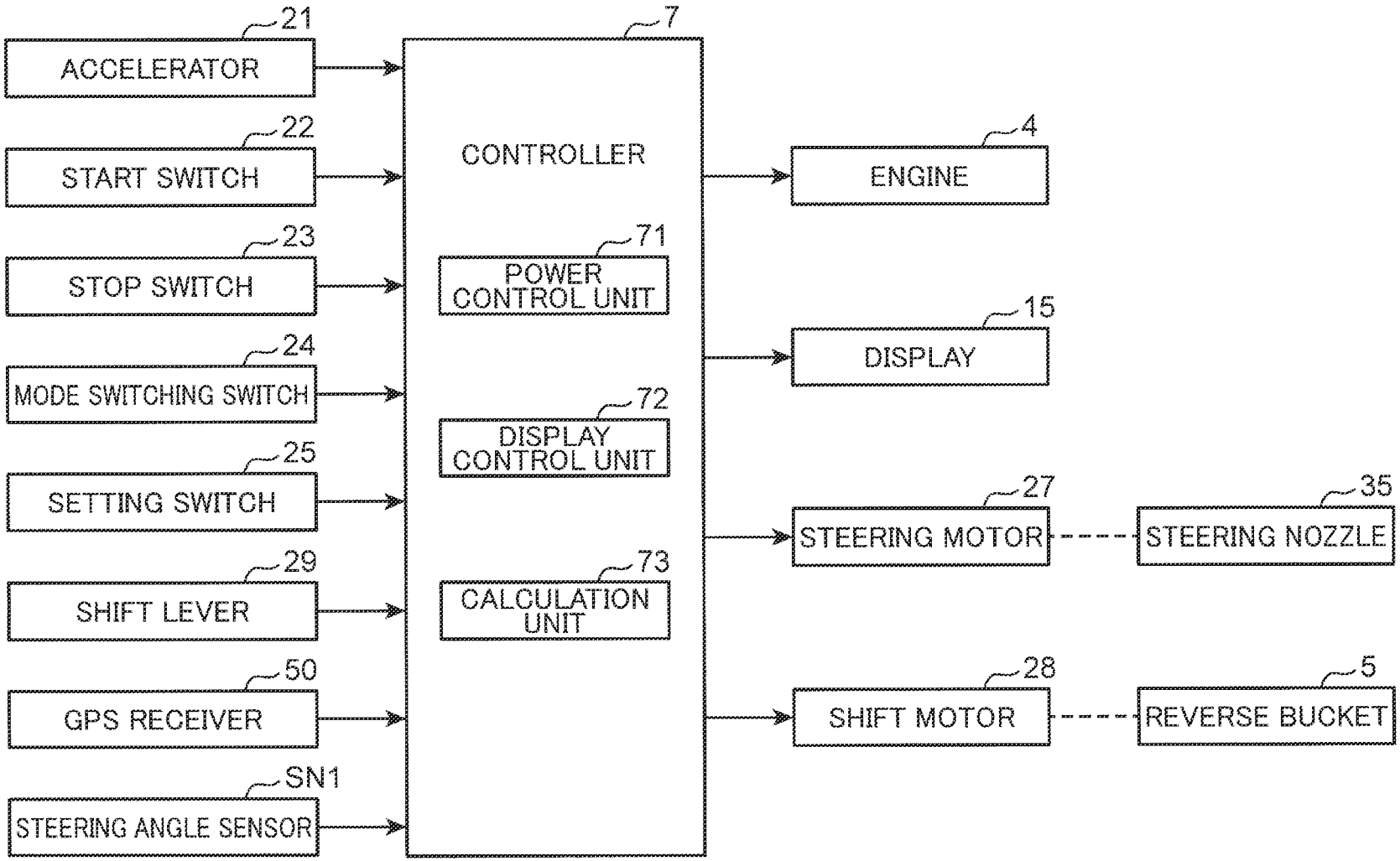
FIG. 3 is a functional block diagram illustrating a control system of the jet-propelled boat.

The display 15 is disposed in front of the handlebar 13. The display 15 has a function as an operation unit that receives a touch operation of the driver M in addition to the above-described function of displaying various types of information related to navigation of the jet-propelled boat 1. That is, the display 15 is a liquid crystal touchscreen display including a touch sensor that responds to a touch operation of the driver M. The display 15 displays a mode switching switch 24 and a setting switch 25 (FIG. 3). The mode switching switch 24 is a touch switch for selecting the operation mode of the jet-propelled boat 1. The setting switch 25 is a touch switch for performing various settings related to the operation mode.

In the present embodiment, as the operation mode selectable by the mode switching switch 24, at least two types of modes, a normal mode and a fixed position mode, are prepared. The normal mode is an operation mode in which the power unit 2 is controlled so that the jet-propelled boat 1 behaves in accordance with the operation of the handlebar 13 and the accelerator 21 by the driver M. The fixed position mode is an operation mode in which the position of the jet-propelled boat 1 is kept within a certain range by automatic control of the power unit 2. The mode switching switch 24 is provided on the display 15 in such a manner that the operation mode can be discretionarily switched between the normal mode and the fixed position mode.

In a case where the fixed position mode is selected by the mode switching switch 24, the setting switch 25 is used to arrange the details of the fixed position mode according to the preference of the driver M. For example, the setting switch 25 can receive an operation of changing a range that restricts the position of the jet-propelled boat 1 when in the fixed position mode, that is, a radius Lr (FIG. 6) of a target range R described later.

A steering angle sensor SN1 (FIG. 3) is attached to a shaft portion (stem) of the handlebar 13. The steering angle sensor SN1 is a sensor that detects the steering angle of the handlebar 13.

A GPS receiver 50 (FIG. 3) is attached to an appropriate position of the deck 12. The GPS receiver 50 is a device capable of receiving a signal transmitted from a GPS satellite and identifying the position of the jet-propelled boat 1 (ship body 10) on the earth based on the received signal. The GPS receiver 50 corresponds to the "position detection unit" in the present disclosure.

As illustrated in FIG. 1, the power unit 2 includes the engine 4, a jet pump 3 that is driven by the engine 4 to inject water, and a reverse bucket 5 disposed at an outlet of the jet pump 3.

The engine 4 is, for example, a water-cooled four-stroke multicylinder engine using gasoline as fuel, and is a drive source that generates a driving force for driving the jet pump 3. The engine 4 is accommodated in an engine room ER formed inside the hull 11. The engine 4 includes a crankshaft 41 extending in the front-rear direction as an output shaft.

The jet pump 3 is a pump that generates a jet water flow injected rearward by pressurizing and accelerating the water taken into the impeller passage 37 from the water inlet 36. The jet pump 3 includes a pump shaft 31, an impeller 32, a stator vane 33, a pump case 34, and a steering nozzle 35.

The pump shaft 31 is coaxially coupled to the rear end of the crankshaft 41. The impeller 32 is attached to the rear end part of the pump shaft 31. The driving force of the engine 4 is transmitted to the impeller 32 via the crankshaft 41 and the pump shaft 31 to rotate the impeller 32 about the axis. The impeller 32 generates a jet water flow by rotating. The stator vane 33 is attached behind the impeller 32 and straightens a jet water flow generated by the impeller 32. The pump case 34 is disposed behind the impeller 32 and rotatably supports the rear end part of the pump shaft 31.

The steering nozzle 35 is a nozzle having an injection port 39 for jetting a jet water flow generated by the impeller 32, and is disposed behind the pump case 34. The steering nozzle 35 has a tapered shape in which a passage cross-sectional area decreases toward the rear. By being supported via a support shaft extending in the up-down direction, the steering nozzle 35 is swingable to the left and right.

The steering nozzle 35 is swung left and right in accordance with the steering of the handlebar 13. When the steering nozzle 35 swings left and right, the jetting direction of the jet water flow from the injection port 39 is changed, whereby the traveling direction of the jet-propelled boat 1 is changed.

The steering nozzle 35 is linked with a steering motor 27 (FIG. 3). The steering motor 27 is an electric motor that swings the steering nozzle 35 left and right in accordance with a signal input from the steering angle sensor SN1. During the operation in the normal mode, the steering motor 27 swings the steering nozzle 35 leftward or rightward to an angular position suitable for the steering angle of the handlebar 13 detected by the steering angle sensor SN1. In other words, the jet-propelled boat 1 according to the present embodiment employs an electronically controlled steering system that electrically transmits the steering of the handlebar 13 to the steering nozzle 35.

The rear end part of the impeller passage 37 is a tapered part 38 in which the passage cross-sectional area decreases toward the rear. A rear part of the tapered part 38 enters the inside of the steering nozzle 35. The water taken into the impeller passage 37 from the water inlet 36 is sent to the tapered part 38 and the steering nozzle 35 while being pressurized and accelerated according to the rotation of the impeller 32, and is jetted at a high speed from the outlet of the steering nozzle 35 having a narrowed passage cross-sectional area, that is, the injection port 39.

The reverse bucket 5 is swingable in the up-down direction by being supported by the steering nozzle 35 via a support shaft extending in the left-right direction. Specifically, the reverse bucket 5 is movable between a forward position illustrated in FIG. 1 in which the reverse bucket 5 is swung upward so as not to cover the injection port 39 of the steering nozzle 35, a reverse position in which the reverse bucket 5 is swung downward so as to cover the injection port 39 of the steering nozzle 35 from the rear, and a neutral position between the forward position and the reverse position. When the reverse bucket 5 is in the forward position (FIG. 1), the jet water flow from the injection port 39 is jetted rearward, so that forward propulsive force is applied to the ship body 10 and the jet-propelled boat 1 moves forward. When the reverse bucket 5 is in the reverse position, the jet water flow from the injection port 39 is bent forward by the reverse bucket 5. Due to this, a rearward propulsive force is applied to the ship body 10, and the jet-propelled boat 1 moves rearward. When the reverse bucket 5 is in the neutral position, part of the jet water flow is bent forward, so that the rearward propulsive force and the forward propulsive force are balanced and the movement of the jet-propelled boat 1 is substantially stopped.

The reverse bucket 5 is linked with an electric shift motor 28 (FIG. 3) for swinging the reverse bucket 5. The reverse bucket 5 is movable among the forward position, the reverse position, and the neutral position described above in response to driving by the shift motor 28. A shift lever 29 (FIG. 3) for changing the traveling direction of the jet-propelled boat 1 by switching the position of the reverse bucket 5 is disposed at or near the handlebar 13.

[Control of Jet-Propelled Boat]

FIG. 3 is a functional block diagram illustrating a control system of the jet-propelled boat 1. As illustrated in this figure, the controller 7 receives input signals from the switches and the sensors described above, and outputs control signals to control targets of each unit. That is, the controller 7 is electrically connected to the accelerator 21, the start switch 22, the stop switch 23, the mode switching switch 24, the setting switch 25, the shift lever 29, the GPS receiver 50, and the steering angle sensor SN1, and receives operation signals or detection signals output from these elements. The controller 7 is electrically connected to the engine 4, the display 15, the steering motor 27, and the shift motor 28, and outputs control signals to these elements. Regarding control of the engine 4, the controller 7 controls output of the engine 4 and action such as start/stop of the engine 4 by controlling elements such as a fuel injection valve and an ignition plug provided in the engine 4.

The controller 7 is a control device including, as a main part, a microcomputer including a processor (CPU) that performs calculation, memories such as a ROM and a RAM, and various input/output buses. The controller 7 functionally includes a power control unit 71, a display control unit 72, and a calculation unit 73. The power control unit 71 is a module that mainly controls the planing action of the jet-propelled boat 1. The display control unit 72 is a module that controls the display of the display 15. The calculation unit 73 is a module that performs various calculations and determinations necessary for control of the power control unit 71 and the display control unit 72. The calculation unit 73 corresponds to the "determination unit" and an "estimation unit" in the present disclosure.

Figure 4:
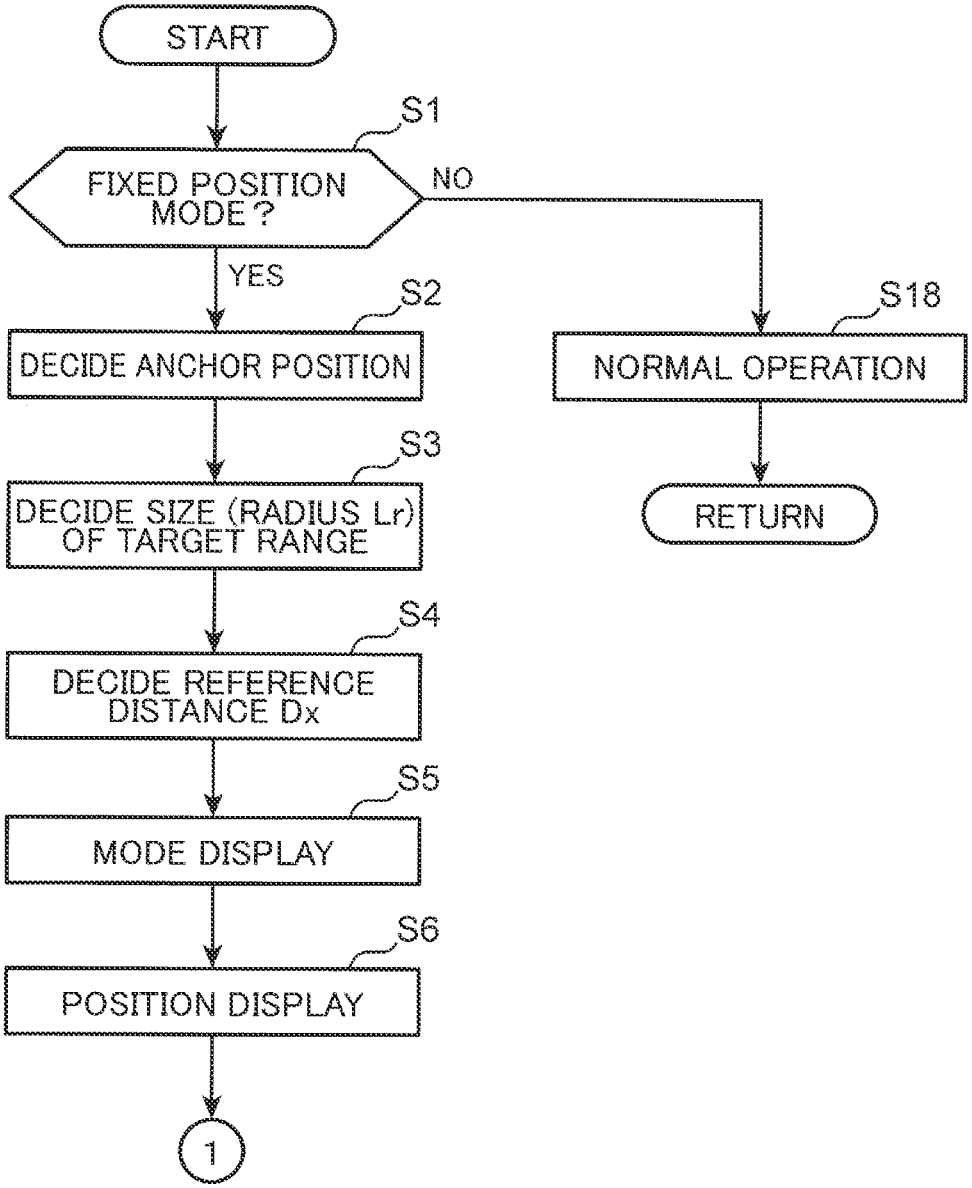
FIG. 4 is a flowchart illustrating the first half of control in the fixed position mode.
Figure 5:
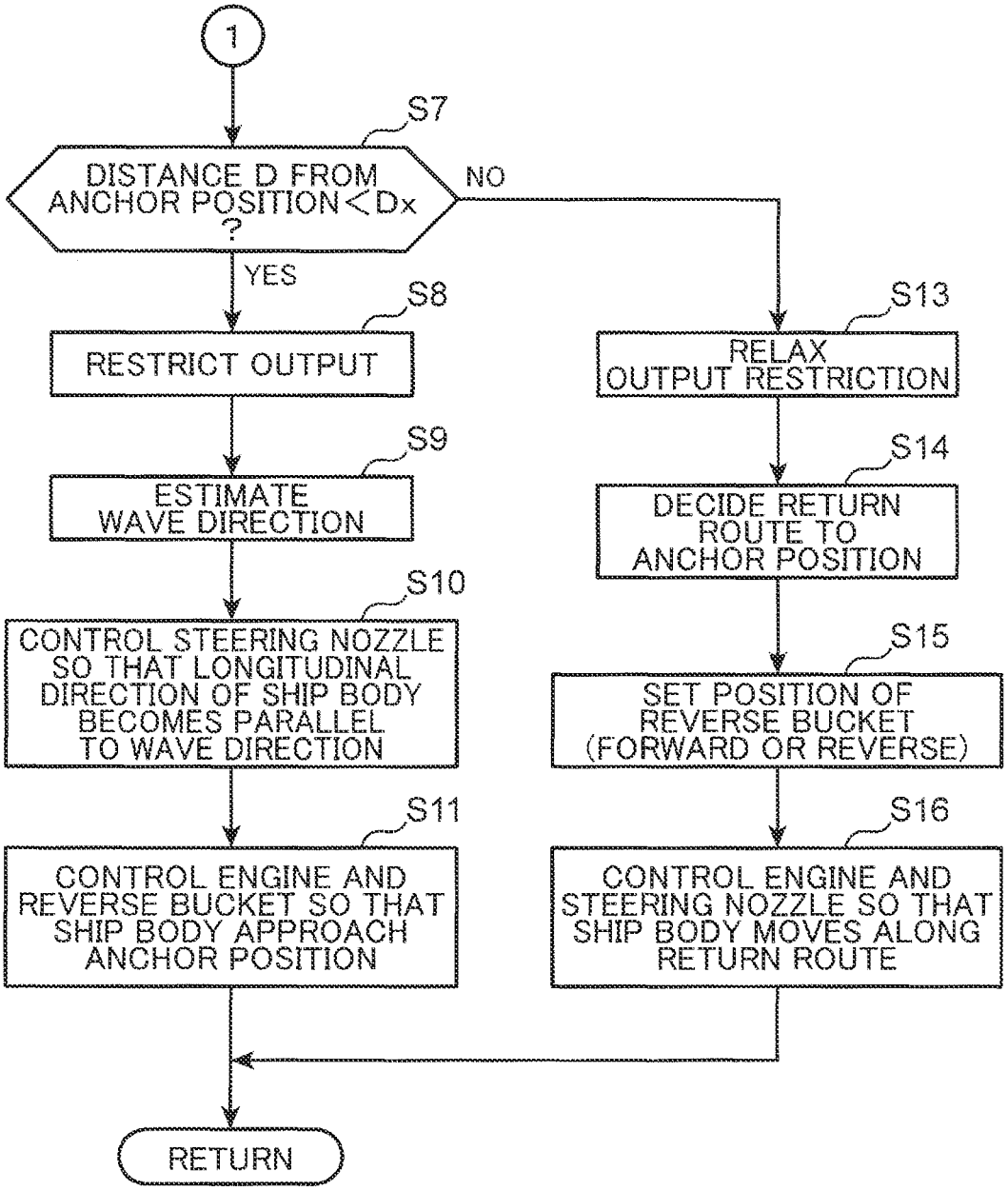
FIG. 5 is a flowchart illustrating the second half of control in the fixed position mode.

Next, content of control performed by the controller 7 described above, particularly, details of the control performed by the controller 7 during the operation in the fixed position mode will be described with reference to the flowcharts illustrated in FIGS. 4 and 5. The control of this flowchart is started at the time point when the driver M turns on the start switch 22 to start the engine 4. After the start of the present control, the calculation unit 73 of the controller 7 determines whether or not the operation mode of the jet-propelled boat 1 is the fixed position mode (step S1). That is, the calculation unit 73 determines whether or not the currently selected operation mode is the fixed position mode based on the operation situation of the mode switching switch 24.

If NO is determined in step S1, that is, if it is confirmed that the current operation mode is not the fixed position mode but the normal mode, the controller 7 executes control according to the normal mode (step S18). For example, the power control unit 71 of the controller 7 controls the engine 4 so as to achieve output according to the accelerator position, which is the operation amount of the accelerator 21, and controls the steering motor 27 so as to achieve the angle of the steering nozzle 35 that matches the steering angle of the handlebar 13 detected by the steering angle sensor SN1. That is, in the normal mode, the power control unit 71 moves the ship body 10 in accordance with the operation of the handlebar 13 and the accelerator 21 by the driver M.

Figure 6:
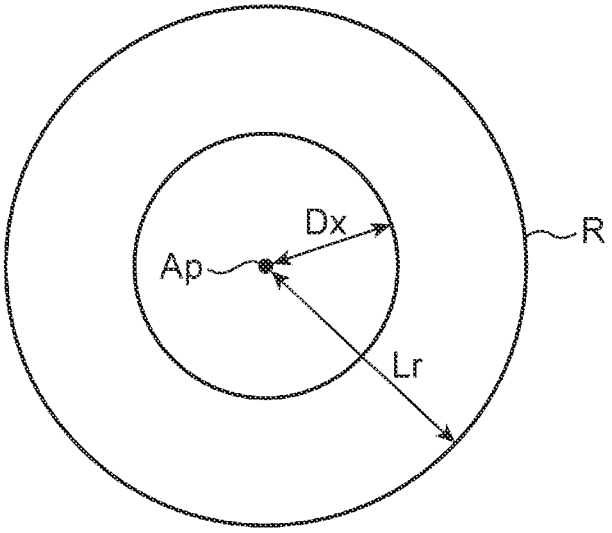
FIG. 6 is a schematic view illustrating an anchor position and a target range set when in the fixed position mode.

On the other hand, if YES is determined in step S1 and it is confirmed that the current operation mode is the fixed position mode, the calculation unit 73 decides an anchor position Ap in the target range R illustrated in FIG. 6 (step S2). Here, since the fixed position mode is an automatic operation mode in which the position of the jet-propelled boat 1 is kept within a certain range, the target range R needs to be determined in advance as a reference for controlling the position of the jet-propelled boat 1. That is, the target range R is an area having a predetermined size determined with the intention of keeping the jet-propelled boat 1 inside the target range R. In step S2, as a first step for determining such the target range R, the anchor position Ap, which is a reference point inside the target range R, is determined. Specifically, in step S2, the calculation unit 73 acquires, from the GPS receiver 50, the position of the ship body 10 at the time point when the mode switching switch 24 for switching the operation mode to the fixed position mode is operated, and decides the acquired position as the anchor position Ap.

Next, the calculation unit 73 decides the size of the target range R (step S3). Here, as illustrated in FIG. 6, in the present embodiment, a circular area about the anchor position Ap is set as the target range R. Therefore, in step S3, the calculation unit 73 decides the radius Lr of the circle represented by the target range R as the size of the target range R. Specifically, the calculation unit 73 decides the radius Lr based on the operation situation of the setting switch 25. That is, in the present embodiment, since the radius Lr can be changed by the setting switch 25, the radius Lr is decided based on the operation situation of the setting switch 25. As described above, the circular area having a radius Lr about the anchor position Ap is set as the target range R.

Next, the calculation unit 73 decides a reference distance Dx illustrated in FIG. 6 (step S4). The reference distance Dx is a threshold used in the subsequent determination (step S7) regarding the distance from the anchor position Ap to the ship body 10. The reference distance Dx is set to a value smaller than the radius Lr of the target range R decided in step S3. For example, the calculation unit 73 decides, as the reference distance Dx, a value obtained by multiplying the radius Lr by a predetermined coefficient larger than 0 and smaller than 1.

Next, the display control unit 72 of the controller 7 causes the display 15 to display a predetermined content indicating that the operation is being performed in the fixed position mode (step S5). The content displayed on the display 15 in step S5 is of any type as long as the driver M can understand driving in the fixed position mode, and for example, some message, pattern (icon), or the like can be displayed on the display 15.

Figure 7:
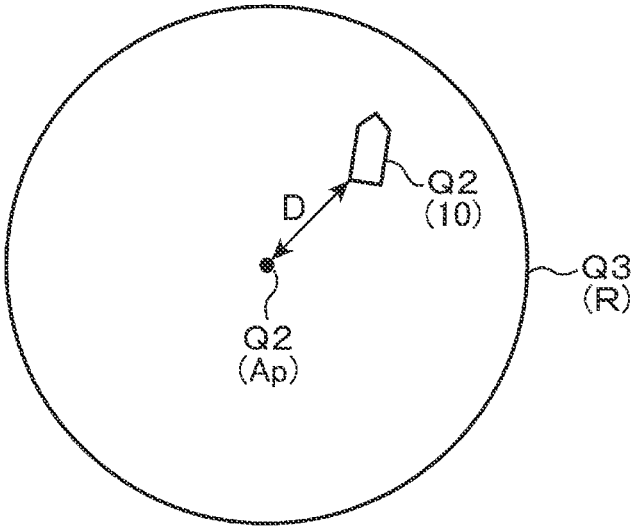
FIG. 7 is a schematic view illustrating content displayed on a display when in the fixed position mode.

Next, the display control unit 72 causes the display 15 to display predetermined display that visually expresses the current position of the ship body 10 in relation to the target range R (step S6). For example, as illustrated in FIG. 7, the display control unit 72 causes the display 15 to display an icon Q1 representing the anchor position Ap, an icon Q2 representing the ship body 10, and an icon Q3 representing the outer periphery of the target range R. Such display can be performed based on the anchor position Ap decided in step S2, that is, the position of the ship body 10 detected by the GPS receiver 50 at the time of switching to the fixed position mode, the current position of the ship body 10 also detected by the GPS receiver 50, and the radius Lr of the target range R decided in step S3.

Next, the calculation unit 73 calculates a distance D from the anchor position Ap to the current position of the ship body 10 based on detection information by the GPS receiver 50, and determines whether or not the calculated distance D is less than the reference distance Dx decided in step S4 (step S7).

If YES is determined in step S7 and it is confirmed that the distance D is less than the reference distance Dx, the power control unit 71 performs output restriction to lower the upper limit of the output of the engine 4 than the original maximum output of the engine 4 (step S8).

Next, the calculation unit 73 estimates the direction of the wave that pushes against the ship body 10 (step S9). For example, the calculation unit 73 specifies, from the detection information of the GPS receiver 50, the direction in which the ship body 10 has moved when the engine 4 is in an idling state, and estimates the specified direction as a wave direction W illustrated in FIG. 8. That is, in a case where the ship body 10 moves when the engine 4 is in the idling state, the moving direction can be regarded as the direction in which the ship body 10 is swept by the wave. Therefore, the calculation unit 73 specifies the moving direction of the ship body 10 when the engine 4 is in the idling state most recently, and estimates the specified direction as the wave direction W.

Next, the power control unit 71 controls the angle of the steering nozzle 35 so that the longitudinal direction of the ship body 10 is parallel to the wave direction W (step S10). That is, by controlling the angle of the steering nozzle 35 independently of the steering angle of the handlebar 13 detected by the steering angle sensor SN1, the power control unit 71 adjusts the orientation of the ship body 10 so that the direction of a center line C of the ship body 10 becomes parallel to the wave direction W as illustrated in FIG. 8.

Next, the power control unit 71 controls the engine 4 and the reverse bucket 5 so that the ship body 10 approaches the anchor position Ap (step S11). That is, the power control unit 71 estimates the moving direction of the ship body 10 necessary for bringing the ship body 10 close to the anchor position Ap based on the positional relationship between the current position of the ship body 10 and the anchor position Ap, and controls the position of the reverse bucket 5 according to the estimated direction, that is, the required moving direction. For example, in the situation illustrated in FIG. 8, since the anchor position Ap exists behind the ship body 10, it is necessary to reverse the ship body 10 in order to bring the ship body 10 close to the anchor position Ap. In other words, the required moving direction in the situation of FIG. 8 is rear. In this case, the power control unit 71 sets the position of the reverse bucket 5 to the reverse position, and drives the engine 4 within the output restriction set in step S8. This can achieve movement of the ship body 10 moving rearward toward the anchor position Ap.

Figure 8:
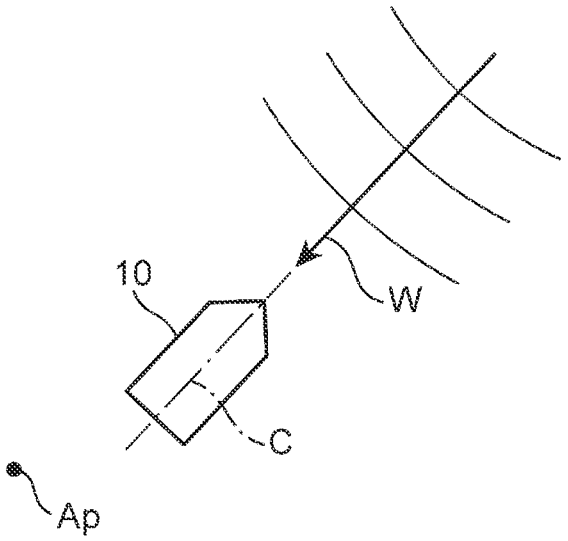
FIG. 8 is a schematic view illustrating a relationship between a ship body and a wave.

On the other hand, in a situation opposite to that in FIG. 8, that is, in a case where the moving direction (required moving direction) of the ship body 10 required to bring the ship body 10 close to the anchor position Ap is front, the power control unit 71 sets the position of the reverse bucket 5 to the forward position and drives the engine 4 within the output restriction set in step S8. This can achieve movement of the ship body 10 moving forward toward the anchor position Ap.

Next, control if the determination in step S7 is NO, that is, if the distance D from the anchor position Ap to the ship body 10 is equal to or greater than the reference distance Dx will be described. In this case, the power control unit 71 relaxes the output restriction of the engine 4 (step S13). That is, the power control unit 71 sets the upper limit of output of the engine 4 higher than the upper limit set in step SB. However, the upper limit of the output set here is also lower than the original maximum output of the engine 4. In other words, the output of the engine 4 in the fixed position mode is generally restricted as compared with that in the normal mode.

Figure 9:
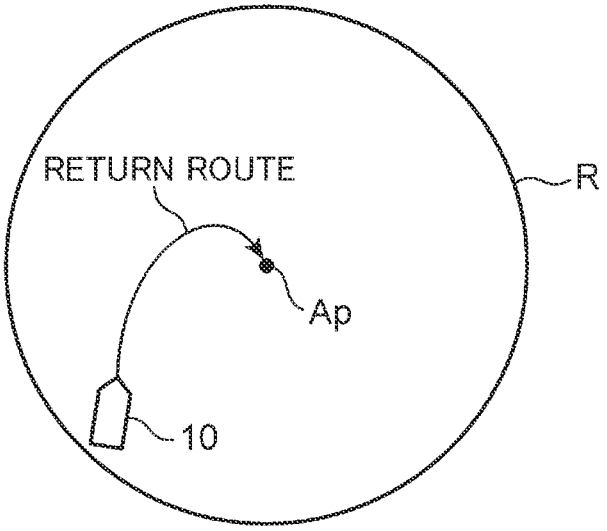
FIG. 9 is a schematic view illustrating a scene in which the ship body is returned to the anchor position.

Next, the calculation unit 73 decides a return route for returning the ship body 10 to the anchor position Ap (step S14). Although the return route may be a return route by forward movement or a return route by rearward movement, in the present embodiment, the return route is decided after selecting the traveling direction (forward or rearward) of the ship body 10 in which the moving distance is shortened. That is, based on the positional relationship between the current position of the ship body 10 and the anchor position Ap and the current orientation of the ship body 10, the calculation unit 73 determines which of forward and rearward to shorten the moving distance to the anchor position Ap by moving the ship body 10. Then, a route for moving the ship body 10 to the anchor position Ap in the determined traveling direction is decided as the return route. For example, as illustrated in FIG. 9, if the moving distance is shorter when returning to the anchor position Ap by forward movement, a route in which the ship body 10 moves while moving forward to the anchor position Ap is decided as the return route.

Next, the power control unit 71 sets the position of the reverse bucket 5 based on the return route decided in step S14 (step S15). For example, in a case where the decided return route is a return route by forward movement, the power control unit 71 sets the position of the reverse bucket 5 to the forward position. On the other hand, in a case where the decided return route is a route by rearward movement, the power control unit 71 sets the position of the reverse bucket 5 to the reverse position.

Next, the power control unit 71 controls the engine 4 and the steering nozzle 35 so that the ship body 10 moves along the decided return route (step S16). That is, the power control unit 71 drives the engine 4 within the output restriction set in step S13, and adjusts the orientation of the ship body 10 in motion by controlling the steering nozzle 35 independent of the detection value of the steering angle sensor SN1. Due to this, the ship body 10 is moved along the decided return route to return the ship body 10 to the anchor position Ap.

[Operations and Effects]

As described above, in the first embodiment, the fixed position mode for controlling the power unit 2 so that the position of the ship body 10 falls within the target range R including the anchor position Ap is prepared as one of the operation modes of the jet-propelled boat 1, and thus, it is possible to widen the range of applications of the jet-propelled boat 1 and enhance convenience. For example, if the fixed position mode is selected when the driver M heads for the rescue of a person in need of rescue, the ship body 10 can be kept in the vicinity of the position where the driver M is separated from the ship body 10 for rescue, and the action of the driver M returning to the ship body 10 thereafter can be made easy. If the fixed position mode is selected when the driver M goes fishing on the ship body 10, the ship body 10 can be kept in the vicinity of a fishing point decided by the driver M, and the behavior of fishing at a fixed position can be made easy. Thus, the addition of the fixed position mode makes it possible to use the jet-propelled boat 1 for a wide range of uses in addition to moving over water, and thus it is possible to enhance the convenience of the jet-propelled boat 1.

In the first embodiment, since the mode switching switch 24 for receiving the operation of the driver M for switching the operation mode is provided on the ship body 10, the driver M can switch the operation mode to the fixed position mode at a preferred timing, and convenience can be enhanced.

In the first embodiment, since the position of the ship body 10 at the time point when the switching operation to the fixed position mode is performed on the mode switching switch 24 is set as the anchor position Ap (S2), the driver M can set the position of the ship body 10 at the time point of the operation as the anchor position Ap by operating the mode switching switch 24 at a preferred position, and can perform a desired activity while keeping the ship body 10 in the vicinity of the anchor position Ap.

In the first embodiment, since the setting switch 25 for receiving the operation of the driver M for changing the radius Lr of the target range R about the anchor position Ap is provided on the ship body 10, it is possible to set the size of the target range R according to the preference of the driver M, and it is possible to enhance convenience.

In the first embodiment, when in the fixed position mode, a predetermined content indicating that the boat is in operation in the fixed position mode is displayed on the display 15 (S5), and thus, it is possible to cause the driver M to appropriately recognize that the boat is in operation in the fixed position mode through the display 15.

In the first embodiment, when in the fixed position mode, visual display including the icon Q1 representing the anchor position Ap and the icon Q2 representing the ship body 10 is displayed on the display 15 (FIG. 7), and thus it is possible to cause the driver M to appropriately recognize the current position of the ship body 10 in relation to the anchor position Ap.

In the first embodiment, since the output of the engine 4 is restricted when in the fixed position mode as compared with that before the shift to the fixed position mode, that is, in the normal mode (S8 and S13), it is possible to suppress the fuel consumed in the engine 4 during the operation in the fixed position mode.

In the first embodiment, since the electronically controlled steering system that electrically transmits the steering of the handlebar 13 to the steering nozzle 35 is adopted, the angle of the steering nozzle 35 can be changed independently of the steering angle of the handlebar 13 in the fixed position mode. Therefore, for example, in the fixed position mode, by adjusting the output of the engine 4 while controlling the angle of the steering nozzle 35 so that the ship body 10 faces the desired direction, the position of the ship body 10 can be appropriately controlled so that the ship body 10 does not deviate from the target range R.

In the first embodiment, in a case where the distance D from the anchor position Ap to the ship body 10 is less than the reference distance Dx in the fixed position mode, that is, in a case where the ship body 10 exists in a region relatively close to the anchor position Ap in the target range R, the wave direction W, which is the direction in which the ship body 10 is flowed, is estimated (S9), and the steering nozzle 35 is controlled so that the direction W and the longitudinal direction of the ship body 10 become parallel (S10). Due to this, waves are prevented from hitting the ship body 10 from the side, so that the behavior of the ship body 10 can be relatively stabilized. This leads to prevention of easy expansion of the distance D from the anchor position Ap to the ship body 10.

Furthermore, in a case where the distance D is less than the reference distance Dx, the engine 4 is driven while the forward/rearward movement of the ship body 10 is appropriately switched by the reverse bucket 5 (S11), so that the ship body 10 can be moved in a direction approaching the anchor position Ap, and the distance D from the anchor position Ap to the ship body 10 can be suppressed from increasing as much as possible.

However, for example, depending on the strength and direction of the wave, the distance D can be expanded to the reference distance Dx or more. In this case, since the ship body 10 is close to the outer periphery of the target range R, it is desirable to quickly return the ship body 10 to the vicinity of the anchor position Ap. Therefore, in the first embodiment, in a case where the distance D becomes equal to or greater than the reference distance Dx, a return route for returning the ship body 10 to the anchor position Ap by forward movement or rearward movement is decided (S14), and the reverse bucket 5, the engine 4, and the steering nozzle 35 are controlled so that the ship body 10 moves along the return route (S15 and S16). According to such a configuration, it is possible to appropriately move the ship body 10 to the vicinity of the anchor position Ap while appropriately adjusting the traveling direction and the speed of the ship body 10.

[Modification]

In the first embodiment, the mode switching switch 24 for switching the operation mode is configured by a touch switch displayed on the display 15 (touchscreen), but the mode switching switch may be configured by a mechanical switch. For example, a mechanical mode switching switch may be provided at an appropriate position of the handlebar 13. As such a mechanical mode switching switch, for example, a mechanical mode switching switch including a first switch for switching to the normal mode and a second switch for switching to the fixed position mode can be used. Alternatively, a toggle switch capable of performing swinging operation in the first direction leading to switching to the normal mode and swinging operation in the second direction leading to switching to the fixed position mode may be used as the mode switching switch.

In the first embodiment, the position of the ship body 10 at the time point when the operation mode is switched to the fixed position mode using the mode switching switch 24 is set as the anchor position Ap. However, an operation unit (interface) for receiving operation of changing the anchor position Ap may be provided, so that the driver M can freely set the anchor position Ap.

In the first embodiment, in a case where the distance D between the ship body 10 and the anchor position Ap in the fixed position mode is less than the reference distance Dx, that is, in a case where the ship body 10 is relatively close to the anchor position Ap, the engine 4 is driven with the output restricted. However, the engine 4 may be stopped under similar conditions. That is, the engine 4 may be stopped in a case where the distance D is less than the reference distance Dx, and the engine 4 may be started in a case where the distance D increases to the reference distance Dx or more. In this way, since the period during which the engine 4 operates during the fixed position mode is shortened, the fuel consumption of the engine 4 can be sufficiently suppressed.

In the first embodiment, the control content for the power unit 2 is changed depending on whether the distance D between the ship body 10 and the anchor position Ap in the fixed position mode is less than the reference distance Dx or equal to or greater than Dx, but the same control content may be uniformly performed. For example, the control in the fixed position mode may be the same as the control in steps S13 to S16 (FIG. 5) described above regardless of the distance D.

In the first embodiment, the electronically controlled steering system that electrically transmits the steering of the handlebar 13 to the steering nozzle 35 is adopted, but the electronically controlled steering is not essential. In a case where the electronically controlled steering is not adopted, for example, in a case where the handlebar 13 and the steering nozzle 35 are mechanically connected via a cable or the like, the course of the ship body 10 cannot be freely changed during the fixed position mode, but the ship body 10 can be kept in the vicinity of the anchor position Ap to some extent only by appropriately switching the forward movement and the rearward movement of the ship body 10 using the reverse bucket 5. In this case, it is expected to be difficult to position the ship body 10 within the circular target range R as set in the first embodiment. However, in a band-shaped area including the anchor position Ap, the ship body 10 can be kept inside the area only by switching between forward movement and rearward movement. In other words, the shape of the target range R in the present disclosure is not limited to a closed shape such as a circular shape, and may be a belt-like non-closed shape.

In the first embodiment, as an example of the small planing boat according to the present disclosure, the small planing boat 1 of a straddle type including the driver's seat 14 has been described. However, the small planing boat may be of a stand-up type on which the driver rides in a standing position.

(2) Second Embodiment

In the first embodiment described above, the operation mode is switched to the fixed position mode in accordance with the operation of the mode switching switch 24 by the driver M. However, the trigger for mode switching is not limited to the operation by the driver M. An example of mode switching triggered by a factor other than the operation by the driver M will be described as the second embodiment. In the second embodiment, the same constituent elements as those of the first embodiment are denoted by the same reference numerals, and the description thereof will be omitted. The same applies to the third and fourth embodiments described later.

Figure 10:
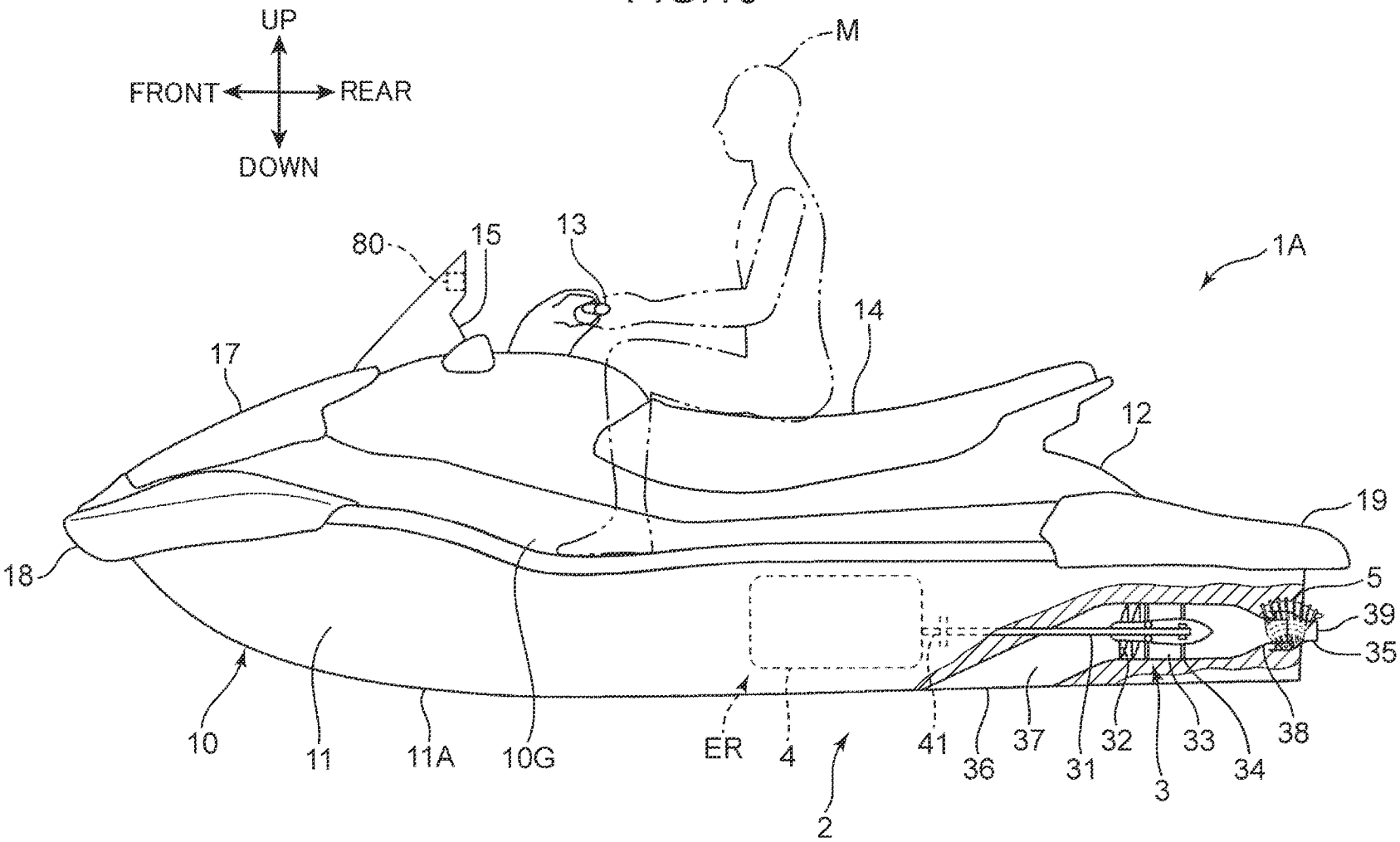
FIG. 10 is a view corresponding to FIG. 1, illustrating a jet-propelled boat according to a second embodiment of the present disclosure.

FIG. 10 is a view corresponding to FIG. 1, illustrating a jet-propelled boat 1A according to the second embodiment. As illustrated in this figure, the jet-propelled boat 1A includes a camera 80 that photographs the driver M. The camera 80 is disposed in the front upper part of the deck 12 so as to be able to photograph the driver M from the front. Specifically, in the present embodiment, the camera 80 is disposed at an attachment part of the display 15 positioned in front relative to the handlebar 13. However, the camera 80 only needs to be disposed at a position where the movement of the driver M can be checked, and in that sense, the camera 80 can be arranged at an appropriate position on the deck 12.

Figure 11:
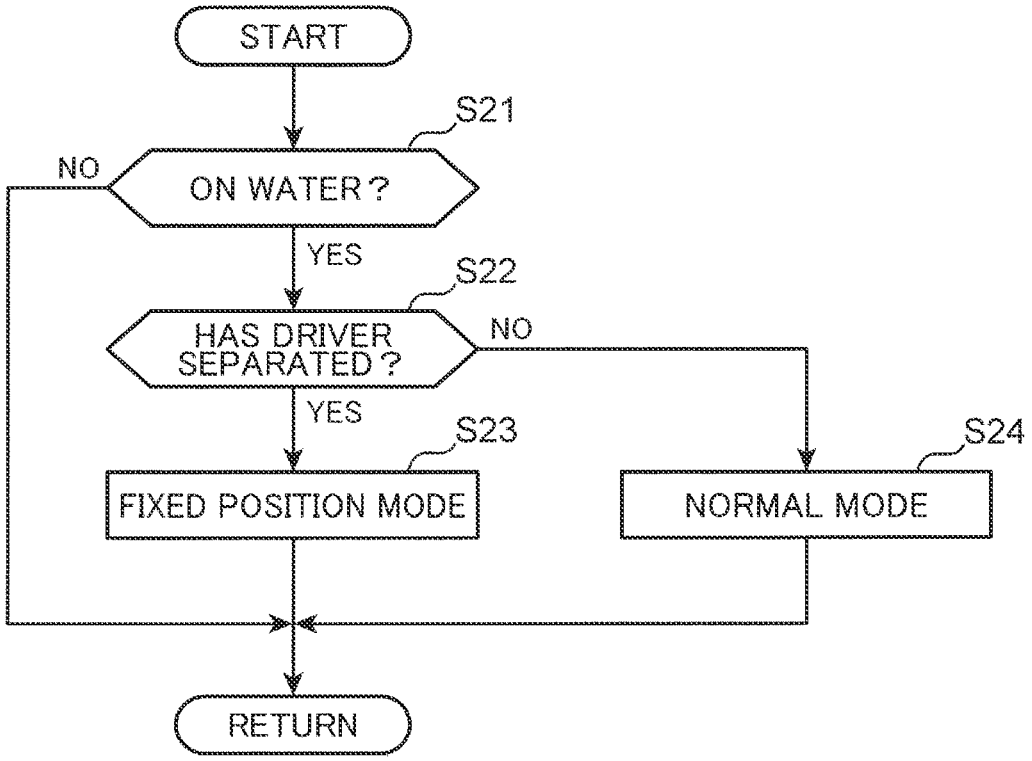
FIG. 11 is a flowchart illustrating content of control in the second embodiment.

In the second embodiment, separation of the driver M from the ship body 10 on water is detected using the camera 80, and in a case where the separation is detected, the operation mode is automatically switched to the fixed position mode. FIG. 11 is a flowchart illustrating content of control performed to implement such mode switching. When the control illustrated in this figure is started, the calculation unit 73 (FIG. 3) determines whether or not the ship body 10 is on the water (step S21). This determination can be made based on the position of the ship body 10 specified by the GPS receiver 50, for example.

If YES is determined in step S21 and it is confirmed that the ship body 10 is on the water, the calculation unit 73 determines whether or not the driver M has been separated from the ship body 10 based on the image of the driver M photographed by the camera 80 (step S22). The camera 80 used for such an application corresponds to a "separation detection unit" in the present disclosure.

If YES is determined in step S22 and the separation of the driver M is confirmed, the controller 7 determines that the operation mode has shifted to the fixed position mode and executes control according to the fixed position mode (step S23). That is, similarly to steps S2 to S16 in FIGS. 4 and 5, control to position the ship body 10 within the target range R including the anchor position Ap is executed.

On the other hand, if NO is determined in step S22 and it is confirmed that the driver M has not been separated, the controller 7 executes control according to not the fixed position mode but the normal mode, that is, control to move the ship body 10 according to the operation of the driver M (step S24).

As described above, in the second embodiment, in a case where it is confirmed that the driver M is separated from the ship body 10 on the water, that is, the driver M is separated from the ship body 10 and enters the water, the operation in the fixed position mode is executed. Therefore, the driver M separated from the ship body 10 can easily return to the ship body 10, and the convenience of the jet-propelled boat 1 can be enhanced. For example, in a case where the driver M swims out of the ship body 10 for rescue of a person in need of rescue, the power unit 2 is controlled such that the ship body 10 stays in the vicinity of the position (anchor position Ap) of the ship body 10 at that time point, so that the driver M can easily return to the ship body 10 after rescue.

In the second embodiment described above, the separation of the driver M from the ship body 10 is detected using the camera 80 capable of photographing the driver M. However, the method for detecting separation of the driver M is not limited to this. For example, separation of the driver M may be detected by using a load sensor that measures the weight applied from the driver M to the ship body 10. Alternatively, separation of the driver M may be detected by using a switch that actuates in response to disconnection of a tether connecting the driver M and the ship body 10 or a sensor that detects the disconnection. Furthermore, after a communication unit capable of communicating with a wearable terminal carried by the driver M is provided on the ship body 10, separation of the driver M may be detected based on the communication state between the communication unit and the wearable terminal.

(3) Third Embodiment

Figure 12:
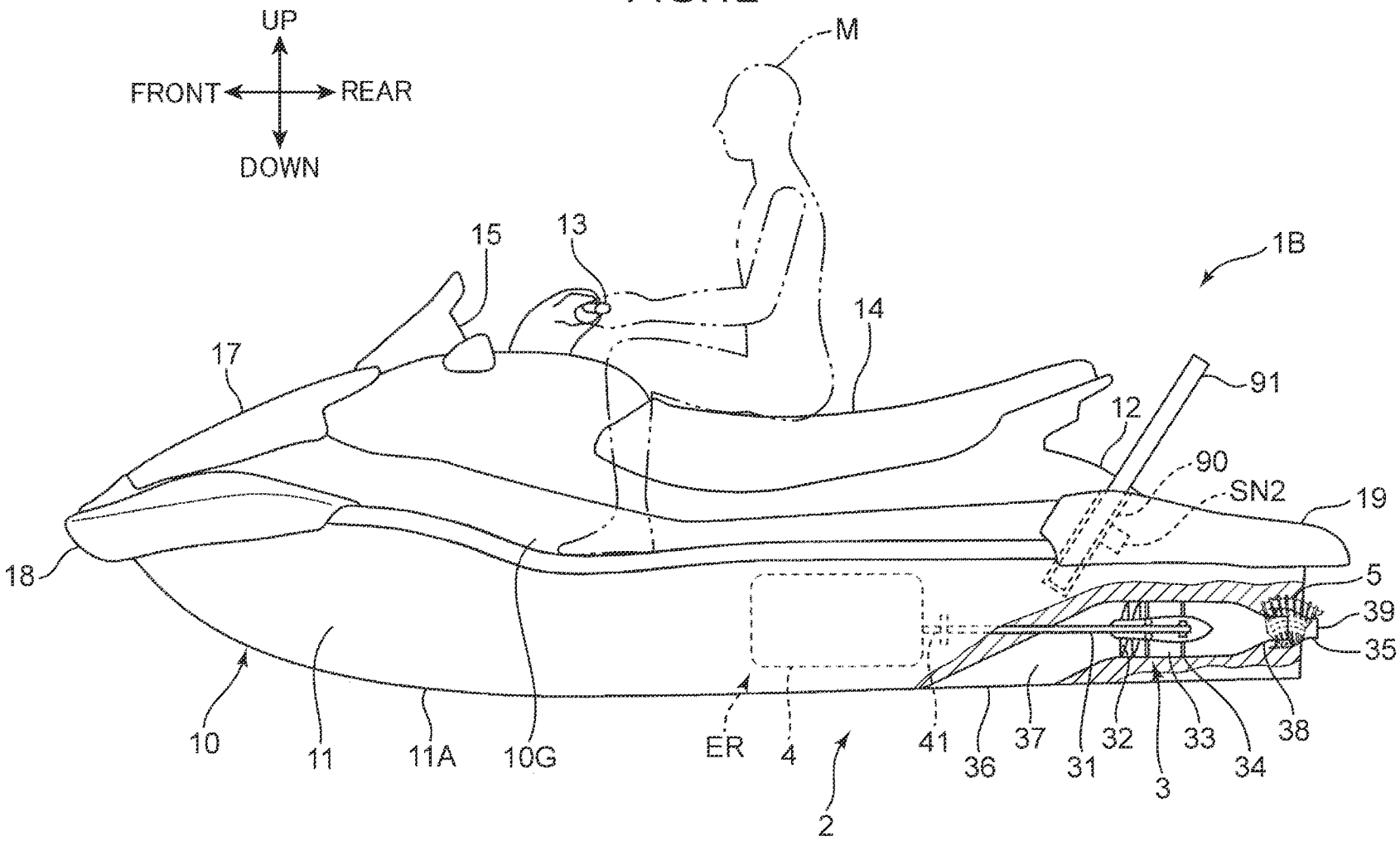
FIG. 12 is a view corresponding to FIG. 1, illustrating a jet-propelled boat according to a third embodiment of the present disclosure.

An example in which switching to the fixed position mode is performed by another trigger will be described as the third embodiment. FIG. 12 is a view corresponding to FIG. 1, illustrating a jet-propelled boat 1B according to the third embodiment. As illustrated in this figure, the jet-propelled boat 1B includes an accommodation unit 90 for accommodating a fishing rod 91 in the deck 12. Specifically, in the third embodiment, the cylindrical accommodation unit 90 into which a part of the fishing rod 91 can be inserted is formed in the rear cover 19 of the deck 12. However, it is sufficient that the accommodation unit 90 is provided in the ship body 10 so as to be able to accommodate the entire or a part of the fishing rod 91, and in that sense, an accommodation unit having an appropriate shape can be formed at an appropriate position of the ship body 10.

A rod sensor SN2 for detecting insertion and removal of the fishing rod 91 into and from the accommodation unit 90 is arranged in the accommodation unit 90. The rod sensor SN2 is a sensor that detects the presence or absence of the fishing rod 91 by an optical or mechanical unit, for example.

Figure 13:
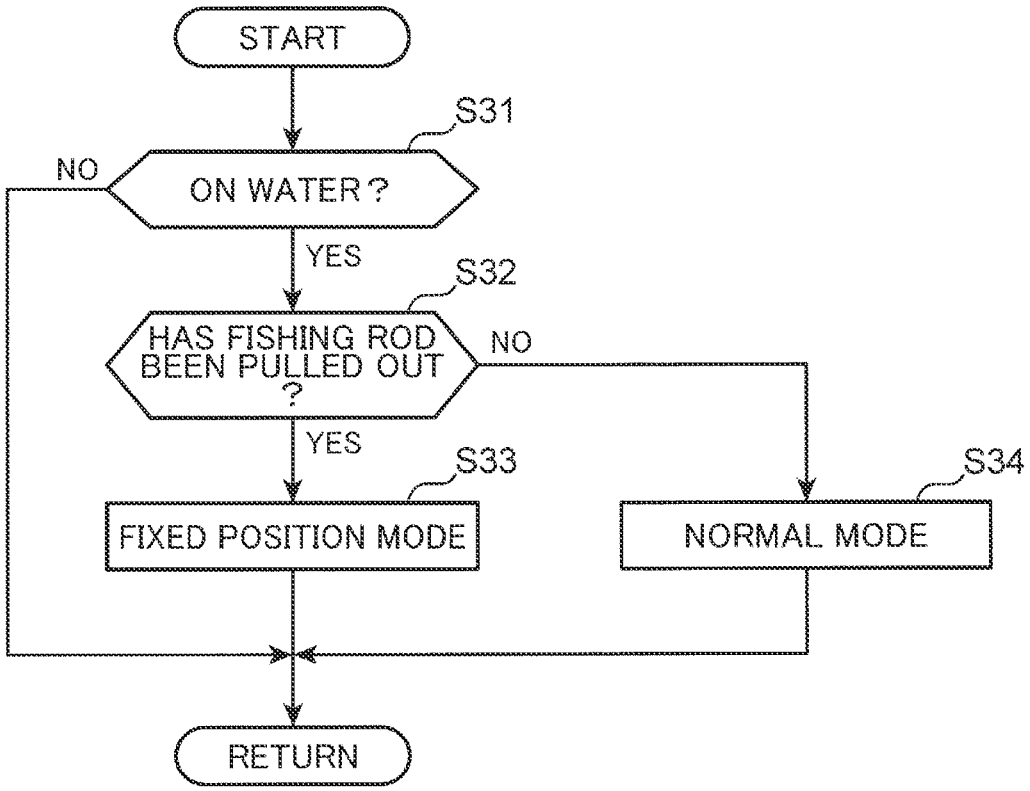
FIG. 13 is a flowchart illustrating content of control in the third embodiment.

In the third embodiment, fishing behavior of the driver M is detected by using the rod sensor SN2, and in a case where the fishing behavior is detected, the operation mode is automatically switched to the fixed position mode. FIG. 13 is a flowchart illustrating content of control performed to implement such mode switching. When the control illustrated in this figure is started, the calculation unit 73 (FIG. 3) determines whether or not the ship body 10 is on the water based on reception information of the GPS receiver 50, for example (step S31).

If YES is determined in step S31 and it is confirmed that the ship body 10 is on the water, the calculation unit 73 determines whether or not the fishing rod 91 is pulled out of the accommodation unit 90 based on detection information by the rod sensor SN2 (step S32). For example, in a case where an input signal from the rod sensor SN2 is switched from a signal indicating that the fishing rod 91 exists in the accommodation unit 90 to a signal indicating that the fishing rod 91 does not exist, it is determined that the fishing rod 91 has been pulled out of the accommodation unit 90.

Here, the fact that the fishing rod 91 has been pulled out of the accommodation unit 90 means that the driver M is about to fish. Therefore, the determination in step S32 of determining whether or not the fishing rod 91 has been pulled out of the accommodation unit 90 is equivalent to determining the presence or absence of fishing behavior. The rod sensor SN2 used for such determination corresponds to a "fishing behavior detection unit" in the present disclosure.

If YES is determined in step S32 and the intention of fishing behavior is confirmed, the controller 7 determines that the operation mode has shifted to the fixed position mode and executes control according to the fixed position mode (step S33). That is, similarly to steps S2 to S16 in FIGS. 4 and 5, control to position the ship body 10 within the target range R including the anchor position Ap is executed.

On the other hand, if NO is determined in step S32 and it is confirmed that there is no intention to fish, the controller 7 executes control according to not the fixed position mode but the normal mode, that is, control to move the ship body 10 according to the operation of the driver M (step S34).

As described above, in the third embodiment, in a case where the fishing behavior on the ship body 10 on the water is confirmed, the operation mode is automatically switched to the fixed position mode, so that the ship body 10 can be kept in the vicinity of the position (anchor position Ap) of the ship body 10 at the time point when the fishing behavior is started. This makes it possible to continuously enjoy fishing at a certain fishing point, and it is possible to enhance convenience in fishing.

In the third embodiment described above, the fishing behavior is detected by using the rod sensor SN2 that detects insertion and removal of the fishing rod 91 into and from the accommodation unit 90, but the method for detecting the fishing behavior is not limited to this. For example, the fishing behavior of the driver M may be detected using a camera similar to the camera 80 of the second embodiment described above. Alternatively, in a case where a cooler for storing caught fish is provided on the ship body 10, a sensor for detecting a specific behavior on the cooler may be provided to detect the fishing behavior based on a detection result of the sensor. The specific behavior on the cooler includes behavior of opening the cooler and behavior of actuating a pump that supplies oxygen into the cooler.

(4) Fourth Embodiment

In the first embodiment, an example in which the present disclosure is applied to the jet-propelled boat 1 including the power unit 2 including the engine 4 of an internal combustion type and the jet pump 3 driven by the engine 4 has been described, but the jet-propelled boat to which the present disclosure can be applied is not limited to this. An example in which the configuration of the power unit is changed will be described as the fourth embodiment.

Figure 14:
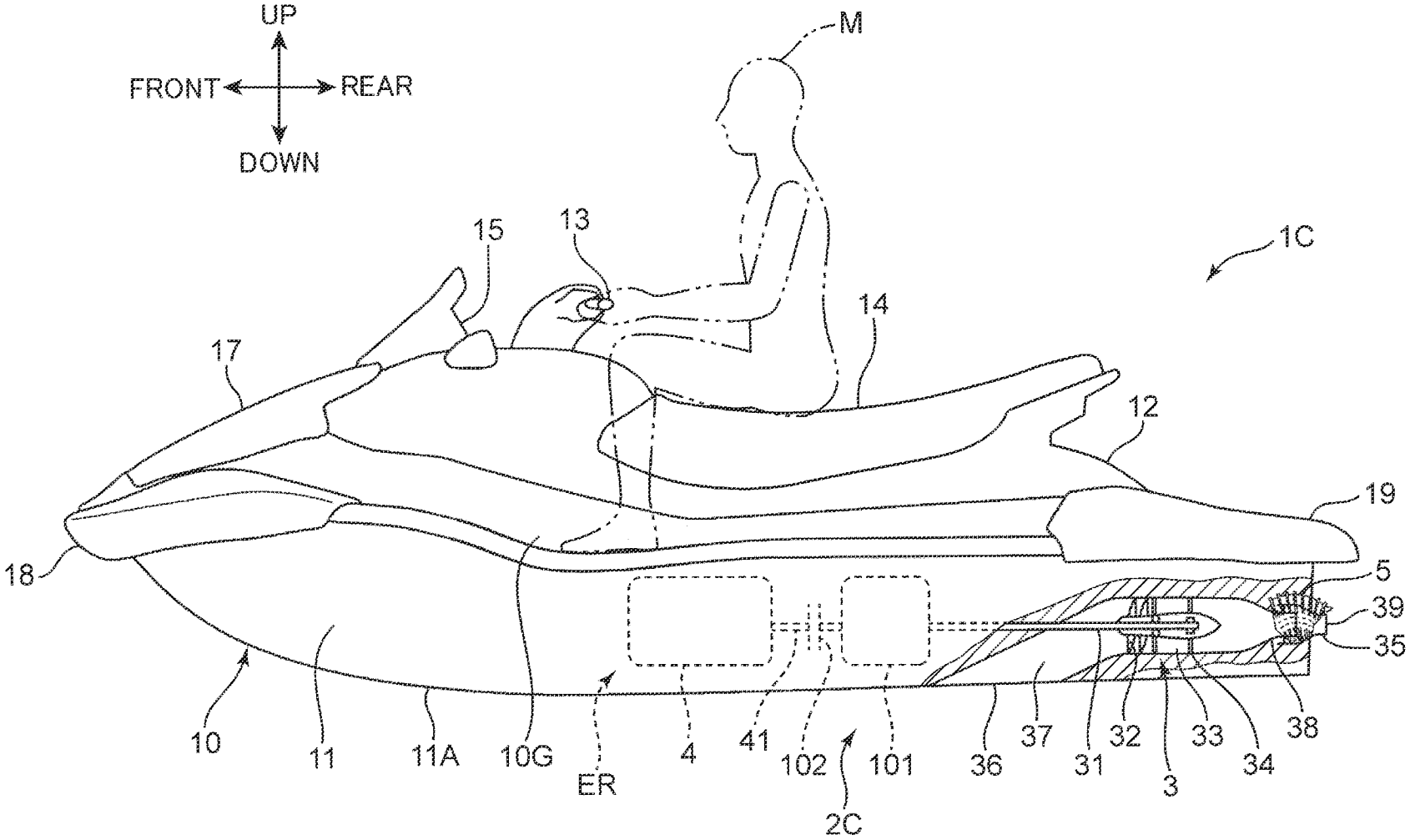
FIG. 14 is a view corresponding to FIG. 1, illustrating a jet-propelled boat according to a fourth embodiment of the present disclosure.

FIG. 14 is a view corresponding to FIG. 1, illustrating a jet-propelled boat 1C according to the fourth embodiment. As illustrated in this figure, the jet-propelled boat 1C includes a power unit 2C including the engine 4, a drive motor 101, the jet pump 3, and the reverse bucket 5. The drive motor 101 is an electric motor driven by power supplied from a battery, and is coupled in series with the engine 4 via a clutch 102.

In the power unit 2C as described above, the drive source for driving the jet pump 3 can be switched by engaging or disengaging the clutch 102. That is, when the clutch 102 is engaged, the crankshaft 41 and the pump shaft 31 of the engine 4 are coupled together via the drive motor 101, and as a result, the engine 4 functions as a drive source of the jet pump 3. On the other hand, when the clutch 102 is disengaged, the coupling between the crankshaft 41 and the pump shaft 31 is released, and as a result, the engine 4 does no longer function as the drive source for driving the jet pump 3. In this case, the drive motor 101 functions as a drive source.

In the fourth embodiment, the position of the ship body 10 is controlled by using the drive motor 101 when in the fixed position mode. That is, the power control unit 71 stops the engine 4 and disengages the clutch 102 when the operation mode is switched from the normal mode to the fixed position mode. Then, the drive motor 101 is driven to generate a propulsive force from the jet pump 3. In other words, in the fourth embodiment, with the switching to the fixed position mode, the power unit that applies the propulsive force to the ship body 10 is switched from a mechanism including the engine 4 and the jet pump 3 to a mechanism including the drive motor 101 and the jet pump 3. In this case, the mechanism including the drive motor 101 and the jet pump 3 corresponds to an "additional power unit" in the present disclosure.

As described above, in the fourth embodiment, since the position of the ship body 10 is controlled by using not the engine 4 of an internal combustion type but the drive motor 101 of an electric type when in the fixed position mode, there is an advantage that the energy efficiency can be easily increased. That is, since the fixed position mode is control to keep the ship body 10 in the vicinity (target range R) of the anchor position Ap, a particularly large propulsive force is unnecessary. Therefore, when in the fixed position mode, it can be said that the use of not the engine 4 but the drive motor 101 is more advantageous in terms of energy efficiency. Therefore, the configuration of the fourth embodiment in which the drive motor 101 is driven when in the fixed position mode can contribute to improvement of energy efficiency.

Although the jet pump 3 driven by the engine 4 and the jet pump 3 driven by the drive motor 101 are shared in the fourth embodiment described above, the second jet pump driven by the drive motor may be provided independently of the engine. That is, the ship body 10 may be equipped with, as the additional power unit, a mechanism including the second jet pump for injecting water absorbed from the water inlet and the drive motor of an electric type for driving the second jet pump. Alternatively, a separate propulsive device using a drive motor as a drive source may be externally attached to the ship body 10 as the additional power unit.

(5) Summary

The embodiments and modifications thereof include the following disclosure.

A jet-propelled boat according to an aspect of the present disclosure includes: a ship body provided with a water inlet; a power unit that applies a propulsive force to the ship body by injecting water taken in from the water inlet while pressurizing the water; a position detection unit that detects a position of the ship body; a determination unit that determines whether or not an operation mode is a fixed position mode; and a power control unit that controls the power unit based on detection information by the position detection unit so that a position of the ship body falls within a target range including a specific anchor position in a case where the determination unit determines that the operation mode is the fixed position mode.

According to the present disclosure, since the ship body autonomously stays in the vicinity of the anchor position when in the fixed position mode, it is possible to reduce opportunities for manual operation by the driver and to enhance the convenience of the jet-propelled boat.

Preferably, the jet-propelled boat further includes an operation unit that receives operation of a driver to shift the operation mode to the fixed position mode.

In this aspect, the fixed position mode can be selected at a timing preferred by the driver.

Preferably, the jet-propelled boat further includes an operation unit that receives operation of a driver for deciding the anchor position.

In this aspect, the driver's preferred position can be decided as the anchor position.

Preferably, the jet-propelled boat further includes an operation unit that receives operation of a driver for changing a size of the target range.

In this aspect, a range having an appropriate size according to the preference of the driver can be set as the target range.

Preferably, the jet-propelled boat further includes a separation detection unit that detects separation of a driver from the ship body. The determination unit determines that the operation mode has shifted to the fixed position mode in a case where the separation is detected by the separation detection unit.

In this aspect, it is possible to suppress the ship body from moving away from the driver having separated. This makes it possible to shorten the distance by which the driver separated from the ship body moves in the water before returning to the ship body, and it is possible to facilitate the returning action to the ship body.

Preferably, the jet-propelled boat further includes a fishing behavior detection unit that detects fishing behavior of an occupant. The determination unit determines that the operation mode has shifted to the fixed position mode in a case where the fishing behavior is detected by the fishing behavior detection unit.

In this aspect, since the operation mode automatically shifts to the fixed position mode in response to detection of the fishing behavior, it is not necessary for the driver to manually switch to the fixed position mode at the time of fishing behavior, and it is possible to facilitate the behavior of fishing at the fixed position.

Preferably, the jet-propelled boat further includes a display unit that displays a predetermined content indicating that the boat is in operation in the fixed position mode when in the fixed position mode.

In this aspect, it is possible to cause the driver to recognize that the boat is in operation in the fixed position mode.

Preferably, the jet-propelled boat further includes a display unit that displays the anchor position and a current position of the ship body when in the fixed position mode.

In this aspect, it is possible to cause the driver to recognize the current position of the ship body in relation to the anchor position.

Preferably, the power unit includes a drive source and a jet pump that is rotationally driven by the drive source and injects water. The power control unit restricts output of the drive source when in the fixed position mode as compared with before shifting to the fixed position mode.

In this aspect, it is possible to suppress the energy consumed by the drive source during the operation in the fixed position mode.

Preferably, the jet-propelled boat further includes a handlebar steered by the driver for changing a traveling direction of the ship body. The power unit includes a drive source, a jet pump that is rotationally driven by the drive source and injects water, and a steering nozzle that changes a direction of an injection flow from the jet pump according to a steering angle of the handlebar. The power control unit, when in the fixed position mode, controls an angle of the steering nozzle independently of the steering angle of the handlebar while adjusting output of the drive source, such that a position of the ship body falls within the target range.

In this aspect, by adjusting the output of the drive source while controlling the angle of the steering nozzle so that the ship body faces the desired direction, the position of the ship body can be appropriately controlled so that the ship body does not deviate from the target range.

Preferably, the jet-propelled boat further includes an estimation unit that estimates a direction in which the ship body is flowed. In a case where a distance from the anchor position to the ship body when in the fixed position mode is less than a predetermined value, the power control unit controls the steering nozzle so that the direction estimated by the estimation unit becomes parallel to a longitudinal direction of the ship body.

In this manner, in a case where the longitudinal direction of the ship body is controlled to become parallel to the direction in which the ship body is flowed, that is, the direction of waves, it is possible to stabilize the behavior of the ship body because the waves are prevented from hitting the ship body from the side.

Preferably, the power control unit stops the drive source in a case where a distance from the anchor position to the ship body when in the fixed position mode is less than a predetermined value, and starts the drive source in a case where the distance increases equal to or greater than the predetermined value.

In this aspect, it is possible to shorten a period during which the drive source operates during the fixed position mode, and it is possible to suppress energy consumption by the drive source.

Preferably, the power unit includes a drive source, a jet pump that is rotationally driven by the drive source and injects water, and a reverse bucket that is swingably disposed at an outlet of the jet pump for switching between forward movement and rearward movement of the ship body. The power control unit, when in the fixed position mode, controls an angle of the reverse bucket while adjusting output of the drive source, such that a position of the ship body falls within the target range.

In this aspect, by adjusting the output of the drive source while switching the forward/rearward movement of the ship body using the reverse bucket, it is possible to appropriately control the position of the ship body so that the ship body does not deviate from the target range.

Preferably, the power unit includes an engine of an internal combustion type and a jet pump that is rotationally driven by the engine and injects water. The jet-propelled boat further includes an additional power unit that includes a drive motor of an electric type and applies a propulsive force to the ship body by a driving force of the drive motor. The power control unit stops the engine and drives the drive motor to control a position of the ship body when in the fixed position mode.

In this aspect, when in the fixed position mode, the position of the ship body is controlled by using not the engine of an internal combustion type but the drive motor of an electric type, so that there is an advantage that the energy efficiency can be easily increased.

The invention claimed is:

1. A jet-propelled boat comprising:

a ship body provided with a water inlet;

a power unit that applies a propulsive force to the ship body by injecting water taken in from the water inlet while pressurizing the water;

a position detection unit that detects a position of the ship body;

a determination unit that determines whether or not an operation mode is a fixed position mode; and a power control unit that controls the power unit based on detection information by the position detection unit so that a position of the ship body falls within a target range including a specific anchor position in a case where the determination unit determines that the operation mode is the fixed position mode.

2. The jet-propelled boat according to claim 1, further comprising:

an operation unit that receives operation of a driver to shift the operation mode to the fixed position mode.

3. The jet-propelled boat according to claim 1, further comprising:

an operation unit that receives operation of a driver for deciding the anchor position.

4. The jet-propelled boat according to claim 1, further comprising:

an operation unit that receives operation of a driver for changing a size of the target range.

5. The jet-propelled boat according to claim 1, further comprising:

a separation detection unit that detects separation of a driver from the ship body, wherein the determination unit determines that the operation mode has shifted to the fixed position mode in a case where the separation is detected by the separation detection unit.

6. The jet-propelled boat according to claim 1, further comprising:

a fishing behavior detection unit that detects fishing behavior of an occupant, wherein the determination unit determines that the operation mode has shifted to the fixed position mode in a case where the fishing behavior is detected by the fishing behavior detection unit.

7. The jet-propelled boat according to claim 1, further comprising:

a display unit that displays a predetermined content indicating that the boat is in operation in the fixed position mode when in the fixed position mode.

8. The jet-propelled boat according to claim 1, further comprising:

a display unit that displays the anchor position and a current position of the ship body when in the fixed position mode.

9. The jet-propelled boat according to claim 1, wherein the power unit includes a drive source and a jet pump that is rotationally driven by the drive source and injects water, and the power control unit restricts output of the drive source when in the fixed position mode as compared with before shifting to the fixed position mode.

10. The jet-propelled boat according to claim 1, further comprising:

a handlebar steered by the driver for changing a traveling direction of the ship body, wherein the power unit includes a drive source, a jet pump that is rotationally driven by the drive source and injects water, and a steering nozzle that changes a direction of an injection flow from the jet pump according to a steering angle of the handlebar, and the power control unit, when in the fixed position mode, controls an angle of the steering nozzle independently of the steering angle of the handlebar while adjusting output of the drive source, such that a position of the ship body falls within the target range.

11. The jet-propelled boat according to claim 10, further comprising:

an estimation unit that estimates a direction in which the ship body is flowed, wherein in a case where a distance from the anchor position to the ship body when in the fixed position mode is less than a predetermined value, the power control unit controls the steering nozzle so that the direction estimated by the estimation unit becomes parallel to a longitudinal direction of the ship body.

12. The jet-propelled boat according to claim 10, wherein the power control unit stops the drive source in a case where a distance from the anchor position to the ship body when in the fixed position mode is less than a predetermined value, and starts the drive source in a case where the distance increases equal to or greater than the predetermined value.

13. The jet-propelled boat according to claim 1, wherein the power unit includes a drive source, a jet pump that is rotationally driven by the drive source and injects water, and a reverse bucket that is swingably disposed at an outlet of the jet pump for switching between forward movement and rearward movement of the ship body, and the power control unit, when in the fixed position mode, controls an angle of the reverse bucket while adjusting output of the drive source, such that a position of the ship body falls within the target range.

14. The jet-propelled boat according to claim 1, wherein the power unit includes an engine of an internal combustion type and a jet pump that is rotationally driven by the engine and injects water, the jet-propelled boat further includes an additional power unit that includes a drive motor of an electric type and applies a propulsive force to the ship body by a driving force of the drive motor, and the power control unit stops the engine and drives the drive motor to control a position of the ship body when in the fixed position mode.

* * * * *